US005787958A

United States Patent [19]

Shivkumar et al.

[11] Patent Number: 5,787,958

[45] Date of Patent: Aug. 4, 1998

[54] METHOD, CASTING PATTERN AND APPARATUS FOR GASIFYING RESIDUE DURING METAL CASTING WITH POLYMERS

[75] Inventors: Satyanarayan Shivkumar, Ashland; Christopher Anthony Borg, West Townsend, both of Mass.

[73] Assignee: Worcester Polytechnic Institute, Worcester, Mass.

[21] Appl. No.: 604,915

[22] Filed: Feb. 22, 1996

[51] Int. Cl.[6] ..... B22C 9/02

[52] U.S. Cl. ..... 164/34; 164/45; 164/249

[58] Field of Search ..... 164/34, 45, 55.1, 164/529, 520, 249, 122, 100, 12, 235, 271

[56] References Cited

U.S. PATENT DOCUMENTS

| | | | |
|---|---|---|---|
| 3,002,948 | 10/1961 | Lawther et al. | 260/38 |
| 3,411,563 | 11/1968 | Fleck | 164/69 |
| 3,795,978 | 3/1974 | Raymond et al. | 29/599 |
| 3,809,147 | 5/1974 | Raymond et al. | 164/122 |
| 3,818,578 | 6/1974 | Raymond et al. | 29/527.5 |
| 3,882,942 | 5/1975 | Rohatgi et al. | 164/353 |
| 4,133,471 | 1/1979 | Niwatukino | 228/107 |
| 4,190,093 | 2/1980 | Kearney et al. | 164/34 |
| 4,217,946 | 8/1980 | Murahashi et al. | 164/12 |
| 4,482,000 | 11/1984 | Reuter | 164/34 |
| 4,711,288 | 12/1987 | Harvey | 164/34 |
| 4,865,808 | 9/1989 | Ichikawa et al. | 428/548 |
| 4,917,359 | 4/1990 | Ichikawa et al. | 266/208 |
| 5,179,994 | 1/1993 | Kuhn | 164/100 |
| 5,234,046 | 8/1993 | Kuhn et al. | 164/127 |
| 5,429,172 | 7/1995 | Hand | 164/34 |

FOREIGN PATENT DOCUMENTS

| | | | |
|---|---|---|---|
| 326095 | 8/1989 | European Pat. Off. | 164/34 |
| 1218662 | 2/1964 | Germany | 164/34 |
| 3101565 | 10/1982 | Germany | 164/34 |
| 3802727 | 12/1988 | Germany | 164/34 |
| 1-181944 | 7/1989 | Japan | 164/34 |
| 1-215435 | 8/1989 | Japan | 164/34 |
| 4-262832 | 9/1992 | Japan | 164/34 |
| 48906 | 6/1989 | U.S.S.R. | 164/34 |

*Primary Examiner*—Scott A. Smith
*Assistant Examiner*—I.-H. Lin
*Attorney, Agent, or Firm*—Hamilton, Brook, Smith & Reynolds, P.C.

[57] ABSTRACT

This invention includes a method, a casting pattern, and an apparatus directed to gasifying residue during metal casting. The method for metal casting includes using a casting pattern that includes an additive that can react with a residue formed as the casting pattern degrades during casting. The casting pattern includes an additive that can react with a residue formed as a result of degradation of the casting pattern during casting. The metal casting apparatus includes a casting pattern having an additive that can react with a residue formed as the casting pattern degrades during casting, and a casting medium in which the casting pattern is at least partially immersed.

42 Claims, 1 Drawing Sheet

METHOD, CASTING PATTERN AND APPARATUS FOR GASIFYING RESIDUE DURING METAL CASTING WITH POLYMERS

BACKGROUND OF THE INVENTION

A metal part is generally cast by immersing a three-dimensional casting pattern of the part in a casting medium, such as unbounded sand, and then displacing the casting pattern with molten metal which subsequently cools to form the metal part. However, displacement of the casting pattern by the molten metal, which necessarily destroys the casting pattern, typically causes a residue of decomposition products from the casting pattern to accumulate at an interface of the molten metal and the casting pattern as the molten metal advances. The residue of decomposition products can include, for example, carbon that remains after decomposition of a polystyrene pattern. Another example of residue includes decomposition products of binders that are employed to form certain types of casting patterns for metal casting. The carbon residue has been shown to comprise as much as about 25% of the weight of the casting pattern, and it can cause a variety of defects, such as blemishes, in cast metal parts and can cause excessive carbon contamination of low carbon steels.

Therefore, a need exists for an improved method of casting that significantly reduces or eliminates the above-mentioned problems.

SUMMARY OF THE INVENTION

The present invention relates to a method, a casting pattern, such as a polymeric casting pattern, such as a polymeric casting pattern, and an apparatus for gasifying residue during metal casting.

The method includes forming a casting pattern that includes an additive that can react with a residue formed as the casting pattern degrades during casting. The casting pattern is at least partially immersed in a casting medium to form a mold. Molten metal is poured into the mold, whereby the molten metal displaces and degrades the casting pattern to produce a residue at an interface of the molten metal and the casting pattern. The residue reacts with the additive to produce a gas which disperses from the interface. In one embodiment, the atmosphere during casting is controlled, such as by supplying a nitrogen atmosphere, to further promote the removal of residue.

The casting pattern includes an additive that can react with a residue formed as a result of degradation of the casting pattern during casting.

The apparatus includes a casting pattern, including an additive that can react with a residue formed as the casting pattern degrades during casting, and a casting medium in which the casting pattern is at least partially immersed.

The present invention includes many advantages. For example, deposits of residue resulting from the degradation of a displaced casting pattern are substantially reduced or eliminated by the method of this invention. Also, the degree to which cast metal parts are contaminated by residue formed during casting can also be substantially reduced or eliminated. Further, the additives employed in casting patterns of the present invention can substitute for binders, thereby potentially eliminating a source of residue that would otherwise accumulate during casting.

DETAILED DESCRIPTION OF THE INVENTION

The features and other details of the invention will now be more particularly described with reference to the accompanying examples and pointed out in the claims. It will be understood that the particular embodiments of the invention are shown by way of illustration and not as limitations of the invention. The principle features of this invention can be employed in various embodiments without departing from the scope of the invention.

The present invention is directed to a method and apparatus for gasifying residue during metal casting. In one embodiment, the method includes forming a casting pattern. The casting pattern is formed of a primary material suitable for casting metal parts. A "primary material" of a casting pattern, as defined herein, is a material that constitutes a substantial part of the volume of the casting pattern, whereby the casting pattern approximates the shape of the metal part to be cast. Examples of suitable primary materials include polyethylene, polypropylene, polystyrene, polymethylmethacrylate, and combinations of polystyrene and polymethylmethacrylate. Preferably, the primary material is polystyrene.

In one embodiment, the primary material is combined with an additive that can react with residue produced from the thermal degradation and displacement of the primary material. An example of a suitable additive is one that oxidizes residue to form a gas. Examples of suitable oxidizing additives are malonic acid, sodium bicarbonate, oxalic acid, potassium nitrate, peroxalates, perborates, persulphates, sodium chloride, potassium chloride, potassium carbonate, barium chloride, calcium chloride, lime, barium nitrate, $Ba(CH_3COO)_2$, acetic acids, adipic acid, stearic acid, other organic acids, nitrates, oxides, carbonates, chlorides, fluorides, sulfates, hydroxides, alcohols, esters, ethers, formaldehyde, urea peroxide, other peroxides, peroxygen compounds and suitable waxes. Preferred oxidizing additives include malonic acid, sodium bicarbonate, oxalic acid and potassium nitrate. However, it is to be understood that other additives, such as compounds that chemically reduce residue, can also be used.

The additive can be combined with the primary material by mixing or dissolving the additive in either the primary material or a precursor, such as a monomer, of the primary material prior to forming the casting pattern. The casting pattern is then formed by a suitable method, such as by injection molding the material, whereby a casting pattern is formed that includes the additive.

Figure 1:
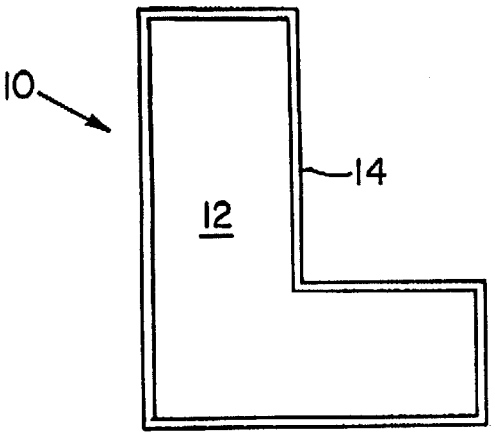
FIG. 1 is a representation of a cross section of one embodiment of a casting pattern of the invention.

Optionally, the casting pattern can be formed by applying the additive to the primary material after the primary material has been formed into a pattern core having a shape substantially similar to that of the casting pattern with slightly smaller dimensions. The additive can be dissolved in a solvent to form a solution. The patten core can then be dipped in the solution and dried. As an alternative to dipping the pattern core in the solution, the solution can be sprayed onto the pattern core. As shown in FIG. 1, casting pattern 10 includes pattern core 12 and additive coating 14.

Figure 2:
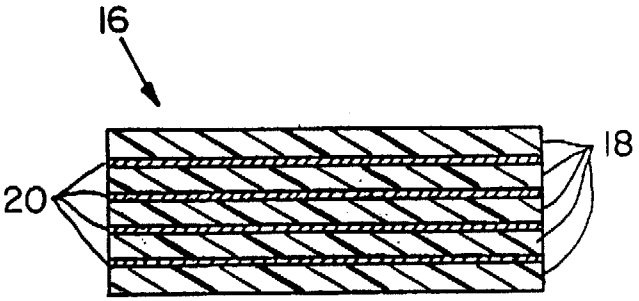
FIG. 2 is a representation of a cross section of another embodiment of a casting pattern of the invention.

In another embodiment, the casting pattern can be formed by forming at least two layers of primary material. At least one layer of additive is then placed between the layer of primary material to form a laminar structure. Remaining layers of primary material and layers of additive are then stacked upon one another to form a resulting laminar composite pattern. As shown in FIG. 2, casting pattern 16 includes layers of primary material 18 and layers of additive 20.

Figure 3:
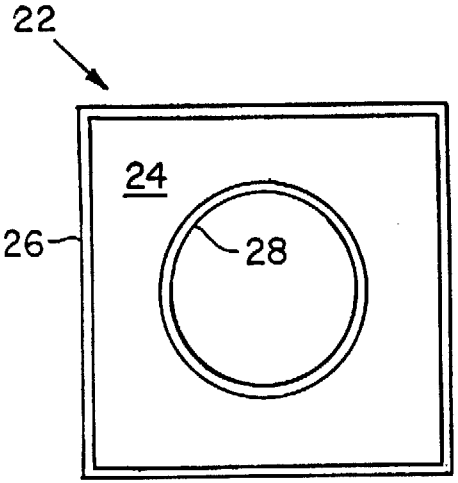
FIG. 3 is a representation of a cross section of a third embodiment of a casting pattern of the invention.

In still another embodiment, the casting pattern can be formed by applying a coating of refractory material to the primary material after the primary material has been formed into a pattern core having a shape substantially similar to that of the casting pattern, but with slightly smaller dimensions. The refractory material can be applied in the form of a slurry to the pattern core. Examples of suitable refractory materials are mica and/or silica-containing slurries, etc. The coated pattern core is then dried to form a casting pattern that approximates the dimensions of the metal part to be cast. As shown in FIG. 3, casting pattern 22 includes pattern core 24 and refractory coatings 26,28.

In this embodiment, the additive can be included either in the pattern core, the refractory coating and/or on the refractory coating. When including the additive in the pattern core, any of the three above-described methods of including the additive in the casting pattern can be employed. When including the additive in the refractory coating, the additive can be dissolved in a refractory slurry. The slurry is then applied to the pattern core, and the pattern core is dried. When applying the additive on the refractory coating, the pattern core is first coated with a refractory material. The additive is then applied to the refractory coating. It is to be understood that the additive can be a component of both the pattern core and any or all coatings on the pattern core.

Figure 4:
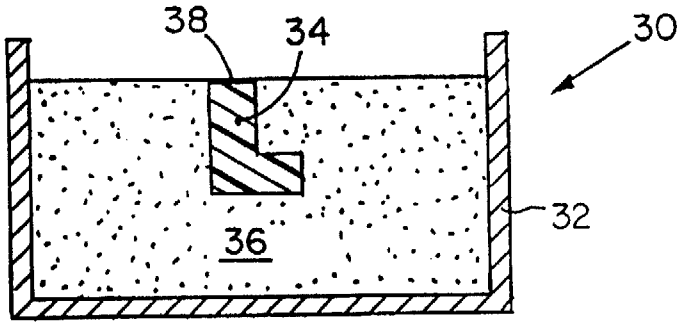
FIG. 4 is a representation of a cross section of one embodiment of an apparatus of the invention.

The casting pattern is at least partially immersed in a suitable casting medium, whereby the medium conforms to the shape of the casting pattern to thereby form a mold. The resulting mold can be porous. An example of a suitable medium that would form a porous mold is unbound sand. Examples of other suitable media include silica sand, etc. The combined pattern, including the additive and the medium that constitutes the mold is one embodiment of the apparatus of the invention. As shown in FIG. 4, apparatus 30 includes vessel 32 containing casting pattern 34 and medium 36 of the mold. Generally, a suitable liquid metal for casting a metal part represented by casting pattern 34 is poured onto an uppermost exposed portion 38 of casting pattern 34. Examples of suitable metals include iron, steel, copper alloys, nickel-base alloys, cobalt-base alloys, etc. The metal is at a temperature that is sufficient to cause the metal to be molten and to cause the material of casting pattern 34 to degrade and be displaced by the metal. A temperature range that is suitable will depend on the material of the casting pattern. For example, a suitable temperature range for degrading and displacing foamed polystyrene of casting pattern 34 is in a range between about 1,250° C. and about 1,600° C.

As the liquid metal is poured onto uppermost exposed portion 38 of casting pattern 34, casting pattern 34 is degraded by the heat of the metal and displaced by the volume and weight of the metal. Degradation of casting pattern 34 causes formation of residue. An example of a residue material is elemental carbon which can be formed by the thermal degradation of foamed polystyrene. Examples of other residue materials include gases, such as light hydrocarbons, etc.

As the residue accumulates, the additive component of casting pattern 34 reacts with the residue. The products of this reaction accumulate to form a gas, which subsequently is dispersed from the mold, either by passing upwardly through the molten metal to a volume in the vessel above the mold, or, in the case of a porous medium, through the pores of the mold.

In embodiments of the casting pattern where the additive is concentrated in layers of a laminar casting pattern, such as is shown in FIG. 2, or is intermixed throughout the casting pattern, the residue can accumulate at an interface between the casting pattern and the advancing molten metal. The residue can accumulate to form residue deposits that move with the advancing interface. As the residue deposits advance through the casting pattern, the deposits will react with the additive to form a gaseous reaction product that disperses from the interface, thereby substantially reducing or eliminating the volume of the residue. Reducing or eliminating the volume of residue, in turn, significantly reduces or eliminates the presence of blemishes caused by residue at the surface of the resulting cast metal part. Contaminates of the metal part by residue can also be reduced or eliminated.

In embodiments of the casting pattern where the additive is in a coating of the casting pattern, such as is shown in FIGS. 1 and 3, deposits of residue will advance with the interface of the molten metal as in the embodiments described above. The deposits will react with the additive to form a gaseous reaction product when the molten metal interface reaches the coating at the outer edge of the casting pattern.

Optimally, in the case of a porous mold, a gas can be directed through the mold while casting the metal part. The gas can be inert to the residue. Examples of suitable inert gases include argon, nitrogen, etc.

Alternatively, the gas can include at least one component that can react with the residue. Examples of such gases include air, oxygen gas, carbon monoxide, carbon dioxide, water, oxides of nitrogen, oxides of sulfur, chlorine gas, sulfur hexafluoride, hydrogen gas, a variety of organic gases, mixtures of any of the above, etc. The gas directed through the mold reacts with accumulated deposits of residue to form a gaseous reaction product that disperses from the interface between the mold and the metal poured into the mold thereby substantially reducing or eliminating deposits not removed by reaction with the additive.

The invention is now further illustrated by the following examples, which are not intended to be limiting in any way. All parts and percentages are by weight unless otherwise specified.

EXAMPLE I

Initially, the degradation of only selected additive material was tested. Both oxalic and malonic acid degraded completely when heated to 1300° C. for 30 seconds. However, potassium nitrate (68% residue) and sodium bicarbonate (51% residue) samples did not degrade completely. The effectiveness of these additives for various modes of addition are examined below.

1. MIXING THE ADDITIVE WITH POLYSTYRENE BEADS

Polystyrene (PS) raw beads were blended with additives in ratios of 1:1, 2:1, and 1:2. Each of the four selected additives, oxalic acid, malonic acid, potassium nitrate and sodium bicarbonate, reduced the residual carbon significantly in comparison to the use of raw beads only. For this and all other calculations of the percent residue, the percent residue was calculated by dividing the weight of the residue by the original weight of the polystyrene. The use of potassium nitrate and malonic acid resulted in the largest decrease in weight, as indicated in Table 1.

TABLE 1

Percent Residue for PS-Additive Mixture Heated to 1,300° C. for 30 Seconds

| PS to Additive Ratio | Raw Beads Only | Raw Beans + Malonic Acid | Raw Beads + Oxalic Acid | Raw Beads + Potassium Nitrate | Raw Beads + Sodium Bicarbonate |
|---|---|---|---|---|---|
| 1:1 | 21.7 | 2.5 | 13.2 | 2.3 | 13.7 |
| 2:1 | 21.7 | 3.9 | — | 18.1 | — |
| 1:2 | 21.7 | 2.6 | — | 25.0 | — |

2. DIPPING A POLYSTYRENE PATTERN IN A SOLUTION CONTAINING THE ADDITIVE

The oxidizers potassium nitrate and sodium bicarbonate were dissolved in water. Polystyrene samples of approximately 0.2 g were dipped in the water oxidizer solution and dried at 45° C. in circulating air. The mass of the dried samples was measured and the samples were placed in 20 ml uncovered fused quartz crucibles. The sample and crucible were heated to 1300° C. for 30 seconds. The sample and crucible were removed and allowed to cool. The percent residue was determined. The data shown in Table 2 indicate a dramatic reduction in the percent residual carbon for both potassium nitrate and sodium bicarbonate.

TABLE 2

Percent Residue for PS Patterns Dipped in a Water Based Solution (10:1) Containing the Appropriate Oxidizer, Dried and Exposed to 1,300° C. for 30 Seconds

| Condition | % non-volatile residue |
|---|---|
| No Additives | 24.0 |
| PS + Potassium Nitrate | 3.5 |
| PS + Sodium Bicarbonate | 8.6 |

3. DIPPING A POLYSTYRENE PATTERN IN OXIDIZER SOLUTION AND REFRACTORY COATING

Potassium nitrate and sodium bicarbonate were separately dissolved in water. A 10:1 ratio by weight of water to additive was used. Polystyrene patterns with masses of approximately 0.2 g were dipped in the solutions, removed, and dried at 45° C. in circulating air. The masses of the coated samples were measured. The coated samples were then dipped in commercial refractory slurries and dried again at 45° C. in circulating air. Two different commercial available refractories, identified as "A" (Styrokote 145.3 PM, commercially available from Borden Foundry and Industrial Resins, Inc.) and "B" (Styrokote 270 WP80, commercially available from Borden Foundry and Industrial Resins, Inc.), were used. The masses of the coated samples were measured once more, and the samples were then placed in 20 ml fused quartz crucibles. The samples and crucibles were heated to 1300° C. for 30 seconds and then removed and allowed to cool at room temperature. Results from these experiments did not indicate any significant reduction in residual carbon. In all likelihood, the dipping to apply the refractory coating washed the additive off of the casting pattern.

4. DISSOLVING THE ADDITIVE IN REFRACTORY SLURRY

The additives were directly added to the refractory slurry. The additives were dissolved in the slurry in three different slurry-to-additive weight ratios, 5:1, 10:1, and 20:1. Polystyrene samples with masses of approximately 0.2 g were dipped in the slurry and allowed to dry. The masses of the dry coated samples were measured and the samples were placed in 20 ml fused quartz crucibles. The crucibles and samples were heated to 1300° C. for 30 seconds. The crucibles and samples were removed and allowed to cool at room temperature, and the amount of residual carbon was measured.

The results of these tests, shown in Table 3, demonstrate that the addition of potassium nitrate and sodium bicarbonate significantly reduced the residual carbon for coating A. Meanwhile, the use of malonic acid with coating A resulted in a slight reduction of residual carbon in comparison to the use of coating A only. When used in conjunction with coating B, the use of potassium nitrate and malonic acid showed a dramatic reduction of residual carbon.

TABLE 3

Influence of Various Additives of Refractory Coatings on the % Non-Volatile Residue

| Type of Additive (Coating: Oxidizer Ratio) | % Non-Volatile Residue Coating A | Coating B |
|---|---|---|
| Coating only | 23.7 | 20.0 |
| Malonic Acid (5:1) | 10.3 | — |
| Malonic Acid (10:1) | 13.1 | 0.5 |
| Malonic Acid (20:1) | 15.4 | — |
| Sodium Bicarbonate (5:1) | 4.4 | — |
| Sodium Bicarbonate (10:1) | 8.0 | — |
| Sodium Bicarbonate (20:1) | 16.3 | — |
| Oxalic Acid (10:1) | 22.6 | — |
| Potassium Nitrate (10:1) | 5.3 | 2.3 |

5. ALTERNATING LAYERS OF POLYSTYRENE AND ADDITIVE IN A LAMINAR STRUCTURE

A polystyrene pattern was sliced into thin sections and weighed. The polystyrene slices had a cross-section of 2.0 cm×3.0 cm and a thickness of between 0.25 cm and 0.5 cm. A laminar structure was then prepared by mounting alternating layers of additive and polystyrene. This sandwich structure was used to measure the percent of non-volatile residue. Two additives were used, malonic acid and potassium nitrate. Results of these experiments, shown in Table 4, indicate a reduction in the residual carbon for both cases.

TABLE 4

Percent Residue for PS-Additive Sandwich Structure

| Condition | % Residue |
|---|---|
| PS only | 25.7 |
| Potassium Nitrate | 10.4 |
| Malonic Acid | 7.1 |

6. SUBJECTING A POLYMER TO A NITROGEN ATMOSPHERE DURING DEGRADATION

Initial experiments were conducted with polystyrene with a mass of approximately 0.2 g placed in the crucible. In some experiments, a lid was placed on-the crucible. The crucible was then placed in a furnace at 1300° C. for 30 seconds. When the crucible was covered by a lid, an average residue of 4% remained. When the crucible was not covered by a lid, an average residue of 21% remained. Further, the morphology of the residue differed in each case. The residue from the covered crucibles was in the form of a thin fine carbon layer on the inside walls of the crucible. The residue from the uncovered crucibles contained large coarse flakes that accumulated on the bottom of the crucible. These results indicate that the composition of the atmosphere during degradation may have a significant effect on the amount of non-volatile residue.

Experiments were conducted with polystyrene for the following three different atmospheres: still air, a flow of compressed air over the crucible during degradation, a flow of nitrogen over the crucible during degradation. The corresponding amounts of non-volatile residue for the three atmospheres were measured to be 25%, 24%, and 11% respectively. Hence, using a nitrogenous atmosphere on the polymer during degradation can lower the amount of non-volatile residue by more than 50%.

EXAMPLE II

Use of Malonic Acid in Reducing the Lustrous Carbon Defects

Objective

Laboratory tests indicated that lustrous carbon defects in iron castings may be reduced by the addition of suitable additives to the polymer pattern and/or the coating. Hence, several iron castings were produced.

Procedure

The first task was to produce the polymer patterns with and without the additive. Expanded polystyrene beads were obtained from the supplier and molded under normal conditions. This corresponds to the pattern without the additive. In the second case, about 8.2 lb. of expanded polystyrene beads were mixed thoroughly with 2.5 lb. (or about 30 wt. %) of malonic acid that had been passed through a 25 mesh screen. This mixture was then used to mold the desired pattern. This corresponds to the pattern with the additive.

The pattern without the additive was then coated with Ashland EP95A refractory coating (Ashland Chemical, Inc.) according to standard operating procedures. In the other case, about 6.6 lb. (or 30% by weight) of malonic acid was added to a 5 gallon bucket of Ashland EP95A refractory coating (Ashland Chemical, Inc.). About 500 ml of water was added to the mixture to arrive at the desired viscosity. The polymer pattern was then coated by repeatedly pouring cupfuls of the above coating mixture on the pattern. The coated pattern was dried according to the normal procedures and cast the following day. Several castings were produced under identical conditions to check for reproducibility.

Results

Lustrous carbon defects in iron castings were reduced significantly upon the addition of malonic acid. A value of 100% defects was assigned for the standard case (i.e. no malonic acid in the pattern or the coating). The castings with malonic acid in the beads only, yielded values between 80% and 100%. However, this value reduced to 10% or 20% when malonic acid was added to both the coating and the pattern.

Equivalents

Those skilled in the art will recognize, or be able to ascertain using no more than routine experimentation, many equivalents to specific embodiments of the invention described specifically herein. Such equivalents are intended to be encompassed in the scope of the following claims.

We claim:

1. A method for gasifying residue during metal casting, comprising the steps of:

a) forming a casting pattern that includes an oxidizing agent that can react with a residue formed as the casting pattern degrades during casting, wherein the oxidizing agent is selected from the group consisting of peroxalates, nitrates, carbonates, malonic acid and oxalic acid;

b) at least partially immersing the casting pattern in a casting medium to form a mold; and c) pouring a molten metal into the mold, whereby the molten metal displaces and degrades the casting pattern to produce a residue at an interface between the molten metal and the casting pattern, and whereby the residue reacts with the additive to produce a gas that disperses from the interface.

2. The method of claim 1 wherein the oxidizing agent includes a peroxalate.

3. The method of claim 1 wherein the oxidizing agent includes a nitrate.

4. The method of claim 1 wherein the oxidizing agent includes a carbonate.

5. The method of claim 1 wherein the residue includes carbon.

6. The method of claim 5 wherein the oxidizing agent includes potassium nitrate.

7. The method of claim 5 wherein the oxidizing agent includes sodium bicarbonate.

8. The method of claim 5 wherein the oxidizing agent includes malonic acid.

9. The method of claim 5 wherein the oxidizing agent includes oxalic acid.

10. The method of claim 5 wherein the casting pattern is formed by a method, comprising the steps of:

a) dissolving the oxidizing agent in a solvent to form a solution;

b) dipping a polymer pattern in the solution to coat the polymer pattern with the solution; and c) drying the coated polymer pattern.

11. The method of claim 5 wherein the casting pattern is formed by a method comprising forming a laminar structure comprised of at least one layer of the oxidizing agent.

12. The method of claim 5 wherein the casting pattern is formed by a method, comprising the steps of:

a) forming a slurry comprised of a refractory coating and the oxidizing agent;

b) coating a polymer pattern with the slurry; and c) drying the coated polymer pattern.

13. The method of claim 5 wherein the casting pattern is formed by a method, comprising the steps of:

a) encapsulating a polymer pattern with a refractory coating; and b) applying the oxidizing agent to the refractory coating.

14. The method of claim 5 wherein the casting pattern is formed by a method, comprising the steps of:

a) dissolving the oxidizing agent in a solvent; and b) spraying the solvent containing dissolved oxidizing agent onto a polymer pattern.

15. The method of claim 5 wherein the casting pattern is formed by a method, comprising the steps of:

a) combining the oxidizing agent with a polymer; and b) forming the combined oxidizing agent and polymer into a casting pattern.

16. The method of claim 1 wherein the mold formed by the casting medium is porous.

17. The method of claim 16 wherein the casting medium includes unbounded sand.

18. A method for gasifying residue during metal casting, comprising the steps of:

a) forming a casting pattern that includes an additive that can react with a residue formed as the casting pattern degrades during casting;

b) at least partially immersing the casting pattern in a casting medium to form a mold;

c) pouring a molten metal into the mold, whereby the molten metal displaces and degrades the casting pattern to produce a residue at an interface between the molten metal and the casting pattern, and whereby the residue reacts with the additive to produce a gas that disperses from the interface; and d) contacting the casting pattern with a gas that can react with the residue.

19. The method of claim 18 wherein the gas includes $N_2$.

20. The method of claim 18 wherein the gas includes $O_2$.

21. The method of claim 18 wherein the gas includes CO.

22. The method of claim 18 wherein the gas includes $CO_2$.

23. The method of claim 18 wherein the gas includes an oxide of nitrogen.

24. The method of claim 18 wherein the gas includes an oxide of sulfur.

25. The method of claim 18 wherein the gas includes $C1_2$.

26. The method of claim 18 wherein the gas includes $SF_6$.

27. The method of claim 18 wherein the gas includes hydrogen.

28. A method for gasifying residue during metal casting, comprising the steps of:

a) forming a casting pattern that includes an additive that can react with a residue formed as the casting pattern degrades during casting;

b) at least partially immersing the casting pattern in a casting medium to form a mold;

c) pouring a molten metal into the mold, whereby the molten metal displaces and degrades the casting pattern to produce a residue at an interface between the molten metal and the casting pattern, and whereby the residue reacts with the additive to produce a gas that disperses from the interface; and d) contacting the casting pattern with an inert gas.

29. The method of claim 28 wherein the inert gas is argon.

30. A casting pattern for metal casting that includes an oxidizing agent that can react with a residue formed as a result of degradation of the casting pattern during casting, wherein the oxidizing agent is selected from the group consisting of peroxalates, nitrates, carbonates, malonic acid and oxalic acid.

31. The casting pattern of claim 30 wherein the oxidizing agent includes a peroxalate.

32. The casting pattern of claim 30 wherein the oxidizing agent includes a nitrate.

33. The casting pattern of claim 30 wherein the oxidizing agent includes a carbonate.

34. The casting pattern of claim 30 wherein the oxidizing agent includes a peroxide.

35. The casting pattern of claim 30 wherein the casting pattern includes a polymer pattern and a coating, and wherein both the polymer pattern and the coating include the additive as a component.

36. The casting pattern of claim 30 wherein the residue includes carbon.

37. The casting pattern of claim 36 wherein the oxidizing agent at least partially encapsulates a pattern core.

38. The casting pattern of claim 36 wherein the casting pattern is a laminar structure comprised of at least one layer of the oxidizing agent.

39. The casting pattern of claim 36 wherein the oxidizing agent is substantially evenly interspersed throughout the casting pattern.

40. The casting pattern of claim 36 wherein the casting pattern includes a pattern core and a refractory coating and wherein the refractory coating at least partially encapsulates the pattern core.

41. The casting pattern of claim 40 wherein the oxidizing agent is a component of the refractory coating.

42. The casting pattern of claim 40 wherein the oxidizing agent at least partially encapsulates the refractory coating.

* * * * *

UNITED STATES PATENT AND TRADEMARK OFFICE

CERTIFICATE OF CORRECTION

PATENT NO. : 5,787,958
DATED : August 4, 1998
INVENTOR(S) : Satyanarayan Shivkumar and Christopher Anthony Borg It is certified that error appears in the above-identified patent and that said Letters Patent is hereby corrected as shown below:

Column 10, Claim 34 should be deleted.

Column 10, existing Claims 35 - 42 should be renumbered to read 34 - 41.

Accordingly, new Claims 36, 37, 38 and 39 depend from new Claim 35, and new Claims 40 and 41 depend from new Claim 39.

Signed and Sealed this

Twenty-second Day of December, 1998

*Attest:*

Bruce Lehman

BRUCE LEHMAN

*Attesting Officer*

*Commissioner of Patents and Trademarks*